US005195410A

United States Patent [19]

Young

[11] Patent Number: 5,195,410

[45] Date of Patent: Mar. 23, 1993

[54] CUTTING BRITTLE MATERIALS

[75] Inventor: Michael J. R. Young, Ashburton, England

[73] Assignee: S.R.A. Developments Limited, Ashburton, England

[21] Appl. No.: 349,455

[22] Filed: May 8, 1989

[30] Foreign Application Priority Data

May 10, 1988 [GB] United Kingdom ..... 8810976

[51] Int. Cl.[5] ..... B28D 1/22

[52] U.S. Cl. ..... 83/13; 83/701; 225/1

[58] Field of Search ..... 225/1, 93; 83/13, 701; 51/59.99

[56] References Cited

U.S. PATENT DOCUMENTS

| | | | |
|---|---|---|---|
| 2,806,328 | 9/1957 | Bradfield | 51/59 SS |
| 3,023,547 | 3/1962 | Tesche | 51/59 SS |
| 3,909,911 | 10/1975 | Smith et al. | 29/427 |
| 3,999,453 | 12/1976 | Damast et al. | 83/13 |
| 4,343,111 | 8/1982 | Inoue | 51/59 SS |
| 4,567,797 | 2/1986 | Folk | 83/13 |
| 4,585,152 | 4/1986 | Sager | 225/1 |

FOREIGN PATENT DOCUMENTS

| | | | |
|---|---|---|---|
| 772875 | 10/1980 | U.S.S.R. | 51/59 SS |

OTHER PUBLICATIONS

"Macrosonics in Industries; Ultrasonic Machining" K. F. Graff, Ultrasonics, vol. 13, No. 3, May 1975.

*Primary Examiner*—Hien H. Phan

*Attorney, Agent, or Firm*—Oblon, Spivak, McClelland, Maier & Neustadt

[57] ABSTRACT

A method of cutting a brittle workpiece comprises applying to the surface of the workpiece a pointed tool, applying high frequency vibrations in a longitudinal direction to the tool, and moving the tool along a line to be cut of the workpiece while applying substantially steady longitudinally directed pressure to the tool. Stress is thereby applied to the workpiece as a combination of short impulses and steady direct stress and the breaking stress of the material would be attained coincident with the peak oscillatory stress. Crack propagation would therefore proceed by a series of stepwise fractures induced by successive cyclic stress peaks, resulting ultimately in the separation of the workpiece into two pieces. An apparatus for carrying out the method comprises a piezoelectric ceramic transducer to generate ultrasonic vibrations, a tip to be applied to the workpiece and having a hardness greater than that of the workpiece, with a tuned horn or the like being utilized to convey the ultrasonic vibrational energy to the tip.

5 Claims, 3 Drawing Sheets

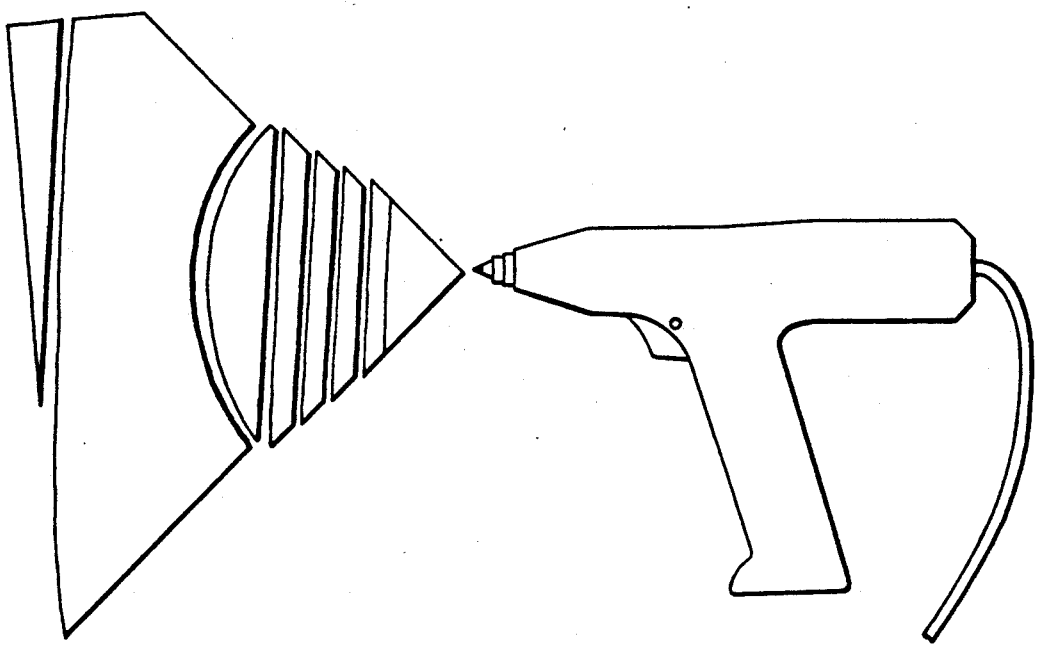
Fig. 6.
Fig. 7.
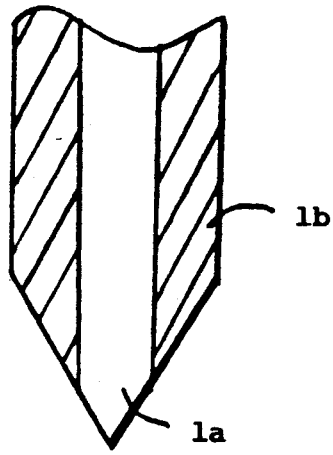

CUTTING BRITTLE MATERIALS

This invention relates to a method and apparatus for cutting brittle materials, and in the preferred embodiment provides a method and apparatus suitable for cutting ceramic tiles and toughened glass.

Ceramic decorative tiles, including floor tiles of the "quarry" type, and toughened glass, are conventionally cut by scoring a line on the surface to act as a stress concentrator, and then bending the workpiece across a suitable edge to cause the material of the workpiece to fracture along the scored line.

This technique suffers from a number of disadvantages. Firstly, if the surface of the item to be cut is very hard it is difficult to form a continuous score line. Even if such a line can be formed, it is difficult to form a curved line accurately and accordingly curved cuts are difficult to make. Also, the technique does not always result in a clean break even when a continuous line has been scored. Finally, very large forces are necessary in order to apply sufficient bending moment to relatively thick tiles of the type used for flooring.

A brittle material allows stress to rise to breaking point without yielding—the stress being relieved by final fracture. If fracture of the lattice occurs as the result of a single impact or a sustained pressure, its effect would only be apparent if the induced stress were sufficient to cause a crack to penetrate through the full thickness of the workpiece. This offers little or no control of the direction or extent of crack propagation. If however, the stress is applied as a combination of short impulses and steady direct stress, the breaking stress of the material would be attained coincident with the peak oscillatory stress. Crack propagation would therefore proceed by a series of stepwise fractures induced by successive cyclic stress peaks, resulting ultimately in the separation of the workpiece into two pieces.

It is an object of the present invention to utilise this discovery to provide a method and apparatus to cut hard fully vitrified and glazed floor tiles, quarry tiles and marble, as well as float glass and special decorative glass. The technique may even be extended to cut and shape concrete products and a range of ceramic and vitreous china materials.

According to a first aspect of the present invention, there is provided a method of cutting a brittle workpiece, the method comprising applying to the surface of the workpiece a pointed tool, applying high frequency vibrations in a longitudinal direction to the tool, and moving the tool along a line to be cut of the workpiece while applying substantially steady longitudinally directed pressure to the tool.

Preferably the vibrations applied to the tool are of a frequency in the region of 8 to 35 kHz.

Where the brittle workpiece is a ceramic tile, a preferred frequency is in the region of 30 kHz.

Where the brittle workpiece is a concrete product, the preferred frequency may be in the region of 10 kHz.

The line to be cut may be linear, curved or contain abrupt changes of direction, e.g. through a right angle.

Advantageously, the high frequency vibrations applied to the tool are derived from ultrasonic vibrations of a piezo electric ceramic transducer.

According to a second aspect of the present invention, there is provided an apparatus for cutting a brittle workpiece, said apparatus comprising a piezo electric ceramic transducer to generate ultrasonic vibrations, a tip to be applied to the workpiece and having a hardness greater than that of the workpiece, and means to convey the ultrasonic vibrational energy to the tip.

The means to convey the ultrasonic vibrational energy to the tip is preferably a tuned horn.

The tip may be of tungsten carbide or other material of equivalent hardness.

In one preferred version, the tip may comprise a core of comparatively hard material and an annular sleeve of material which is comparatively soft but still harder than the material of the workpiece.

In this case, the core may have a diameter of 1 mm and the sleeve an outer diameter of 3 mm. The combination tip may have a length of 7 mm.

In order to transmit the vibration to the tip, it may be fixed within a holder of e.g. stainless steel.

Embodiments of the present invention will now be more particularly described by way of example and with reference to the accompanying drawings, wherein:

FIG. 6 shows the apparatus of FIG. 5 and a ceramic tile cut by the apparatus, and FIG. 7 is an enlarged, broken vertical cross sectional view of a tip constructed in accordance with the invention.

Figure 1:
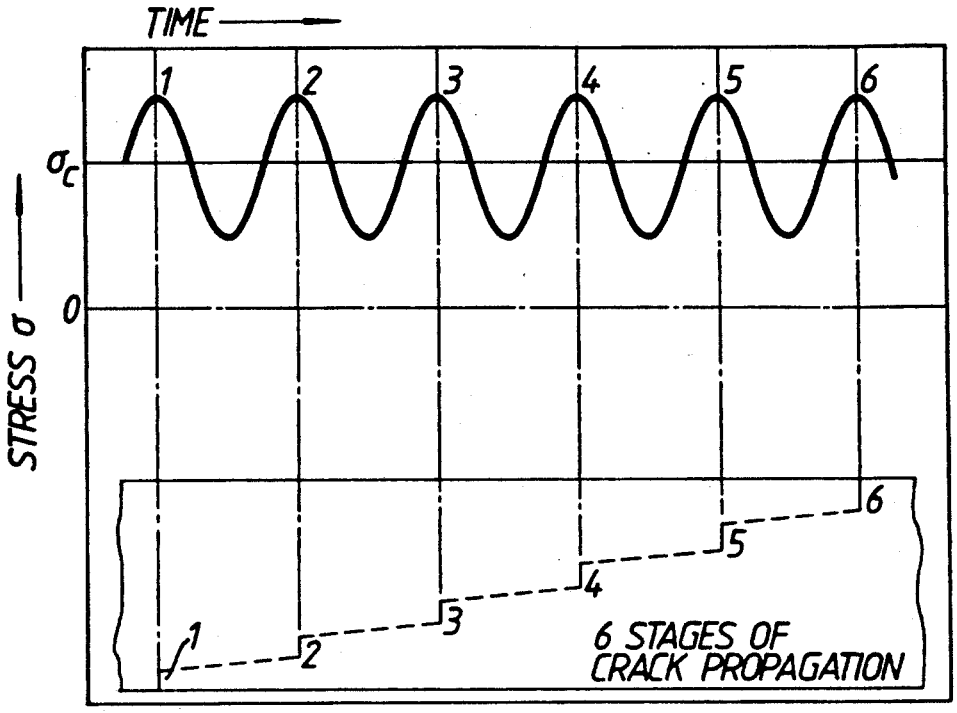
FIG. 1 is a schematic representation of crack propagation in a workpiece.

Referring now to the drawings, FIG. 1 illustrates schematically the mechanism by which the method embodying the invention works. At the top of the Figure is shown the cyclic stress pattern applied by the tool to the workpiece by virtue of high frequency vibrations imparted to the tool With each peak of the stress pattern, a short downward impulse is applied to the workpiece, this impulse being additional to the substantially steady stress being applied thereto, either simply by virtue of the weight of the apparatus or by virtue of downwardly directed manual pressure. (In this connection manual pressure may be taken to include pressure applied by a human hand or by an operative part of a robot or machine.)

Each short impulse raises the total stress on the workpiece instantaneously to the breaking stress of the material and therefore crack propagation begins and increases with each peak. This is shown schematically at the foot of the Figure. Ultimately the workpiece will break along a line transcribed by a tip of the apparatus.

It is possible with a hand held tool to define a path in which such microcracks are generated, using a sharp pointed vibrating tip initially to score the surface of the workpiece. Subsequent movement of the tip back and forth along the prescribed path results in fracture within 4–20 secs. depending on the type of material and the workpiece thickness.

Figure 2:
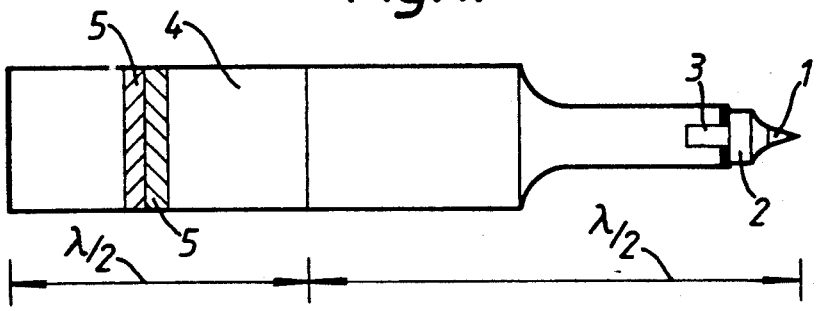
FIG. 2 shows, in longitudinal cross section an apparatus embodying the invention.
Figure 3:
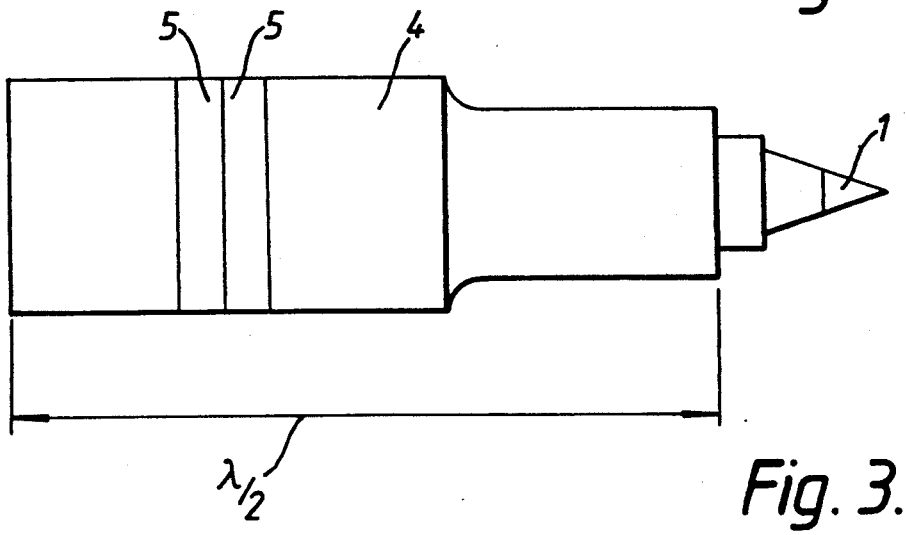
FIG. 3 shows an alternative embodiment of an apparatus, having a stepped output end.

FIGS. 2 and 3 show examples of ultrasonic systems suitable for generating high stresses in hard brittle materials.

In each case the system comprises a sharp tip 1 of hard material, for example tungsten carbide or even diamond, in a stainless steel holder 2. This assembly is screwed, by means of threaded shank 3, into a tuned horn 3*a* connected to a transducer 4 operatively connected with piezoelectric ceramic rings 5.

In the embodiment of FIG. 2, the total length of the apparatus is one wavelength, while in the embodiment of FIG. 3, which shows a transducer with stepped output end, the total length is one half of a wavelength.

One problem which may be encountered is that the tip may become blunted after repeated use. It is possible to resharpen it but it is difficult since the tip is of hard material. In one embodiment as shown in FIG. 7, the tip is a composite having a 1 mm diameter core 1*a* of a hard grade of material within a 3 mm diameter outer sleeve 1*b* of comparatively shoft material. (By "comparatively soft" is meant softer than the core but harder than the material of the workpiece.) With this construction, the sleeve will wear down preferentially, leaving a reasonably sharp tip.

Figure 4:
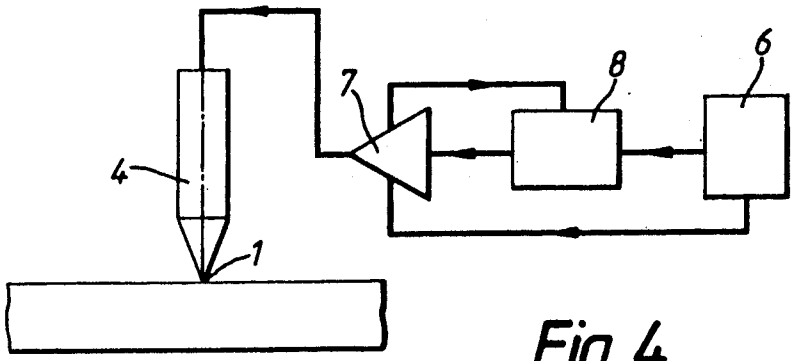
FIG. 4 shows schematically an electronic drive circuit for an apparatus embodying the invention.

The successful operation of such systems will depend on the ability to maintain mechanical resonance in the cutting tip 1 under all loading conditions. The generator output frequency must therefore change to compensate for frequency shifts due to variations in tip length and workpiece characteristics. FIG. 4 shows a schematic circuit for achieving this. The power supply 6 provides DC voltages to the output 7 and resonant drive 8 circuits. The switch mode output is driven by a VCO with PLL frequency control using a signal derived from the output current.

The invention has been described with reference to the necessary high frequency vibrations being producedby piezo electric ceramic transducer systems. However the impulsive forces used to generate the cyclic stress can be produced by several means; viz. an ultrasonic transducer with tuned horn and cutting tip; an electromagnetic vibrator (frequency limit around 10 kHz); by mechanical means, using a cam; or hydraulically. The feature common to each excitation system is that it must operate at a high frequency, in the order of several kHz. It is believed that better control of the rate of crack propagation is achieved the higher the frequency. For example when cutting floor tiles which are typically 8-10 mm thick, adequate control is provided by an ultrasonic system operating at 30 kHz. In concrete products where the stress is relieved by the presence of numerous internal voids in the structure, crack propagation would be much slower and consequently a lower frequency would be expected to provide adequate control e.g. around 10 kHz.

Figure 5:
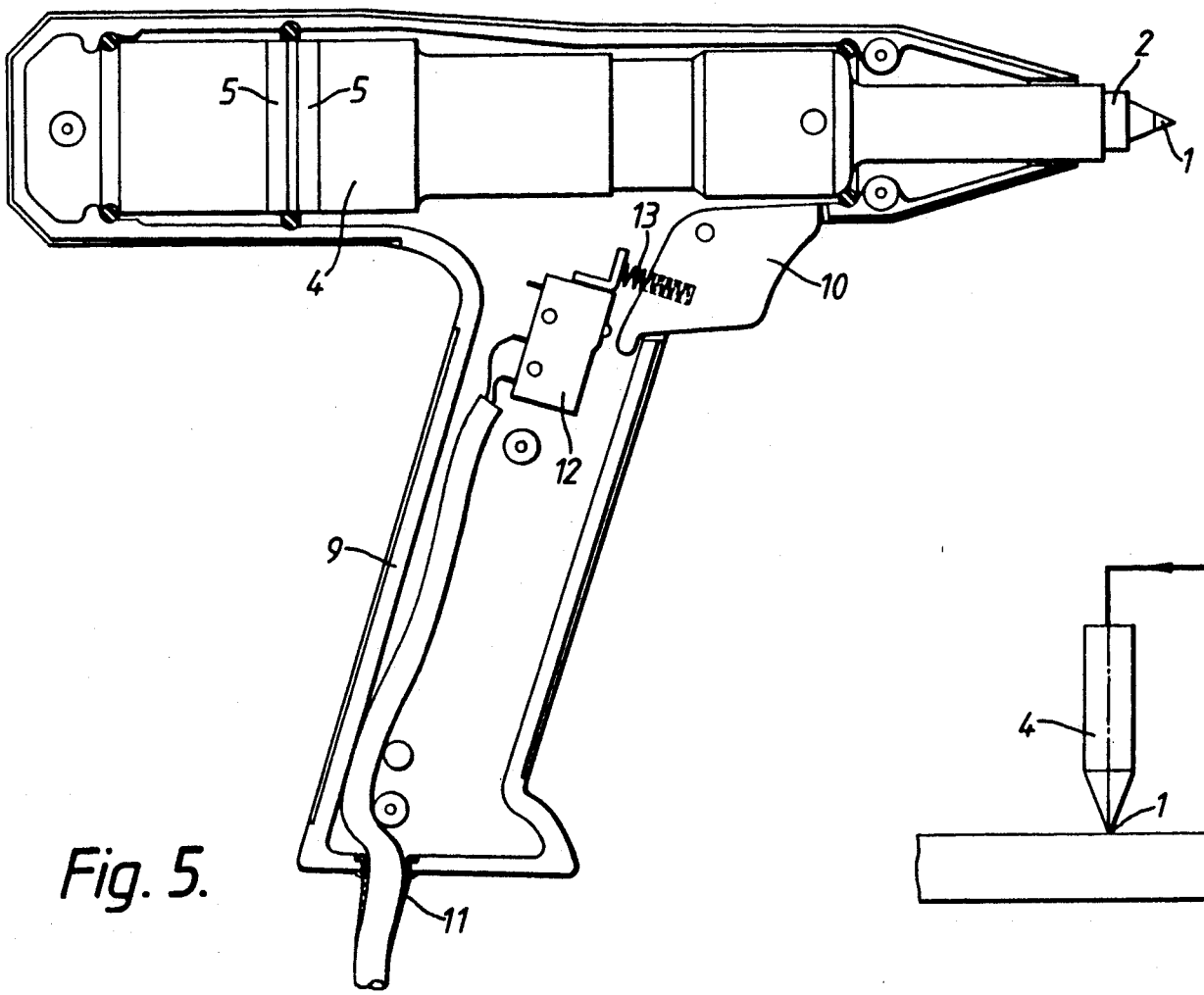
FIG. 5 is a cross-sectional view of an apparatus embodying the invention and a housing therefore.

Referring now to FIGS. 5 and 6, there is shown an apparatus embodying the invention. The vibration generating and transmitting apparatus is essentially as described above. It is housed in a pistol type casing 9 with a trigger 10 for allowing connection between a RF input 11 and the piezo electric ceramic transducer. The trigger 10 acts on a microswitch 12 which can operate a relay in the frequency converter unit. The trigger 10 is biased outwardly by spring 13 so that a positive action is required for the cyclic stress vibration to be set up.

An external view of the tool of FIG. 5 is shown in FIG. 6, together with a ceramic tile cut by the tool. As can be seen, the cut made need not necessarily be linear, as is generally the case with existing tile cutting methods, but may be curved and, in fact, may include abrupt changes of direction. By generating the crack over several impulses of the tip, the crack may increase in depth stepwisely until the workpiece breaks.

I claim:

1. The method of cutting a workpiece of brittle material into two pieces along a predetermined line comprising producing a micro crack in said material by applying directly and alone to the surface of the workpiece at a point on said line the pointed end of a tool, applying high frequency vibrations in a longitudinal direction to the tool while applying substantially steady longitudinal directed pressure from the tool to the workpiece until said micro crack occurs, moving said tool along said line to propagate micro cracks in said workpiece along the length of the line, and then breaking said workpiece along said line into two pieces.

2. A method as claimed in claim 1, wherein the vibrations applied to the tool are of a frequency in the region of 8 to 35 kHz.

3. A method as claimed in claim 2, wherein the brittle workpiece is a ceramic tile and the frequency is in the region of 30 kHz.

4. A method as claimed in claim 2, wherein the brittle workpiece is a concrete product and the frequency is in the region of 10 kHz.

5. A method as claimed in claim 1, wherein the high frequency vibrations applied to the tool are derived from ultrasonic vibrations of a piezoceramic transducer.

* * * * *